United States Patent [19]

Darby

[11] Patent Number: 5,067,256

[45] Date of Patent: Nov. 26, 1991

[54] ACUPRESSURE HEEL CUP

[75] Inventor: H. Darrel Darby, Huntington, W. Va.

[73] Assignee: Darco International Inc., Huntington, W. Va.

[21] Appl. No.: 619,582

[22] Filed: Nov. 29, 1990

[51] Int. Cl.[5] ..... A43B 23/08; A61F 5/14

[52] U.S. Cl. ..... 36/69; 36/37; 36/71; 128/581; 128/614

[58] Field of Search ..... 36/37, 69, 71; 128/581, 128/582, 614

[56] References Cited

U.S. PATENT DOCUMENTS

| | | | |
|---|---|---|---|
| 4,179,826 | 12/1979 | Davidson | 36/71 X |
| 4,325,380 | 4/1982 | Malkin | 36/37 X |
| 4,346,525 | 8/1982 | Larsen et al. | 36/71 X |
| 4,530,173 | 7/1985 | Jesinsky, Jr. | 128/614 X |
| 4,776,109 | 10/1988 | Sacre | 36/37 X |
| 4,928,404 | 5/1990 | Scheuermann | 36/71 X |
| 4,979,343 | 12/1990 | Davidson | 36/37 X |

*Primary Examiner*—Paul T. Sewell

*Assistant Examiner*—Beth Anne Cicconi

*Attorney, Agent, or Firm*—Sughrue, Mion, Zinn, Macpeak & Seas

[57] ABSTRACT

A heel cup of molded rubber or noncompressible resilient, flexible plastic, has a relatively thin sole extending from a heel towards the arch of a user when fitted beneath the user's heel. The rear portion of the sole and opposite side portions thereof are curved upwardly forming a thickened arcuate reinforced heel support configured to the user's heel. A horseshoe shaped rim integral with the sole and the heel support projects below the bottom surface of the sole. A plurality of laterally and longitudinally closely spaced pegs integral with the sole project outwardly of the bottom surface at right angles and are of decreasing vertical height from the integral rim to the front portion of the sole. The pegs have a vertical height in excess of that of the rim in the area of the rim. The pegs affect a first wave-like action of gentle pressure and massage to the soft tissue of the heel from the back to the front of the heel during ambulation of the user.

11 Claims, 1 Drawing Sheet

ACUPRESSURE HEEL CUP

BACKGROUND OF THE INVENTION

1. Field of the Invention

This invention relates to heel cups, pads, heel cushions and the like and, more particularly to a heel cup capable of therapeutic acupressure and massage to the heel of the user when placed in an article of footwear.

2. Background of the Invention

There are many types of heel cups, pads, heel pads and heel cushions. In commercial use for the treatment of various types of heel pain, such cups, pads or cushions are worn in the heel of a shoe or other footwear and act to absorb shock during ambulation. As such, most are used for the treatment of various types of heel pain. As shock absorbing devices, they function to raise the heel slightly. Typically such cups, pads and cushions cushion and support the back of the foot to compensate for different leg lengths, to damp shocks in walking and running and to absorb the maximum impact and shock loads.

The Applicant was introduced to acupressure as a technique for treating heel pain by Professor Chen Bao-Xing, China's leading orthopedic surgeon. Chinese physicians routinely use a T-shaped instrument approximating 1½ inches in diameter. In use, the physician grasps the cross bar of the T and firmly presses the bottom end of the instrument into selected portions of a patients heel. The combination of pressure and massage effectively reduces the congestion of the soft tissue which produces soft tissue decompression to reduce inflammation and edema thereby reducing pain and promoting healing.

It is therefore a primary object of the present invention to produce an acupressure heel cup to provide therapeutic treatment via pressure and massage along with impact shock absorption for the treatment of heel pain, preferably formed by injection molding of a soft resilient, generally non-compressible elastomer plastic or rubber and having a sole portion, underlying and supporting the bottom surface of the heel of the user which permits localized deformation of a plurality of downwardly directed projections spaced from each other and integral with the heel cup sole to apply pressure at localized spaced points over the sole bottom surface during weight bearing.

SUMMARY OF THE INVENTION

This invention is directed to a acupressure heel cup for incorporation within an article of footwear, below the heel of a user. The acupressure heel cup is comprised of a relatively thin sole of a generally non-compressible, resilient material extending from a heel towards the arch of the user and having front, rear and laterally opposite side portions. The rear and side portions are curved upwardly and form a thickened arcuate reinforced heel support. A horseshoe shaped rim, integral with said sole projects below the bottom surface of the sole at the rear thereof. A plurality of laterally and longitudinally closely spaced pegs are integral with the sole over the major bottom surface area thereof and project outwardly of the bottom surface of the sole. The pegs are of decreasing vertical height from the rim to the front portion of the heel cup sole and the pegs, adjacent to the rim have a vertical height extending planatarily beyond the rim in excess of the vertical height of the rim. During ambulation, the plantar aspect of the heel first makes contact at the proximal portion of the heel cup. The weight of the user is gradually transferred from the back to the front of the heel cup and the pegs are forced upwardly, creating individual pressure points against the soft tissues of the heel. A firm, wave-like action of gentle pressure and massage is repeated on each step of the user, to reduce edema, congestion and inflammation of the soft heel tissue thereby reducing heel pain and discomfort.

Preferably, the pegs are solid and may be circular and horizontal cross section. The pegs may be aligned transversely in rows with the pegs of longitudinally adjacent rows being laterally offset from each other and with the pegs of one row centered in the gaps between adjacent pegs of the longitudinally adjacent row. Preferably, the sole tapers in thickness from the rear portion of the sole to the front portion, over the extent of the sole bearing the integral, downwardly projecting pegs. The acupressure heel cup may be injection molded of relatively soft, resilient flexible plastic such as an elastomer or of rubber with a smooth upper surface contoured to the shape of the heel.

BRIEF DESCRIPTION OF THE DRAWINGS

The objects, features and advantages of Applicants invention will become more readily apparent from the following description, reference being made to the accompanying drawings in which.

DESCRIPTION OF THE PREFERRED EMBODIMENTS

Figure 1:
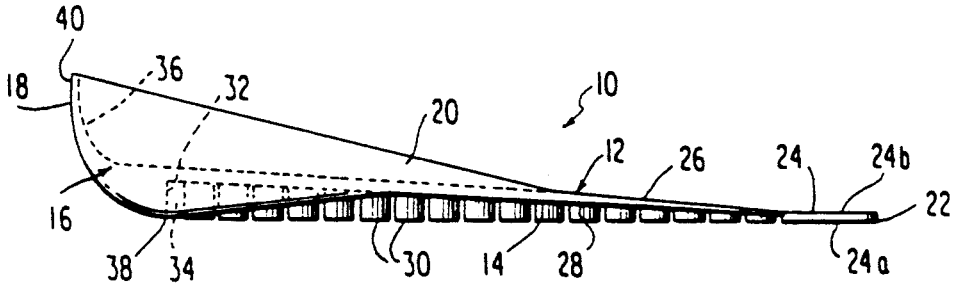
FIG. 1 is a side elevational view of the acupressure heel cup of the forming a preferred embodiment of the invention.
Figure 2:
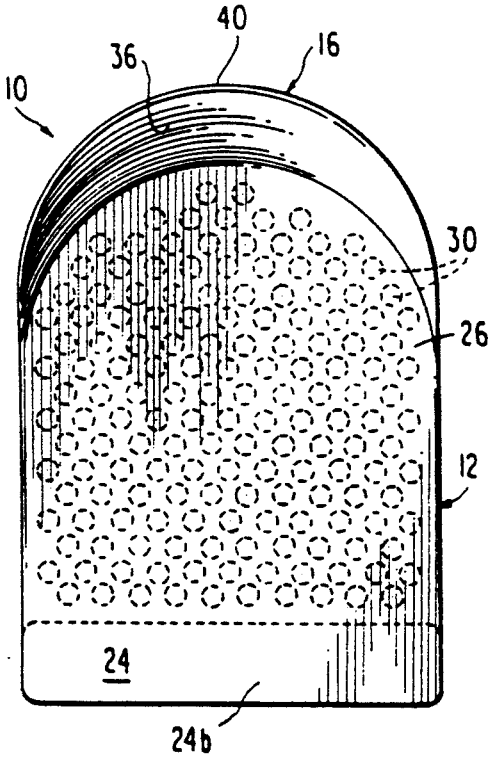
FIG. 2 is a top plan view thereof.

The acupressure heel cup of the invention in the form of a preferred embodiment is shown in the drawings at 10, is preferably injection molded or pour molded of elastomer, plastic, or rubber material such as silicone rubber. The acupressure heel cup 10 is molded, to include as a primary element, a relatively thin sole indicated generally at 12 which has a smooth upper surface 26 contoured to the shape of the users' heel. The heel cup sole 12 has a rear portion or heel support 18, and laterally opposite, integral side portions 20 extending from the rear portion 18 towards a front portion 22. Both the rear, exterior surface 40 of the heel support 18 acupressure heel cup 10, and the arcuate or curved interior surface 36 are, in addition to being hemispheric, concave and convex vertically, respectively. A downwardly projecting horseshoe shaped rim 16 is integral with sole 12, but considerably thickened relative to the near uniform thickness sole 12 of the unitary molded heel cup 10. The flexibility of the heel support 18 increases gradually from the rear of the sole 12 and its integration to horseshoe shaped rim 16, to the upper edge 40 of that heel support. It should be noted, that the integral rim 16 terminates with a near vertical front wall or face 32 thereby defining, a vertical space or a cavity 34 over the arcuate extent of the horseshoe shaped rim 16, beneath the bottom surface 28 of sole 12.

At the front portion 22 of the acupressure heel cup, the sole 12 terminates in a uniform thickness, flat, rectangular plate 24, preferably with opposed flat, horizontal bottom surface **24*a*, and a flat, top surface 24*b***.

Figure 3:
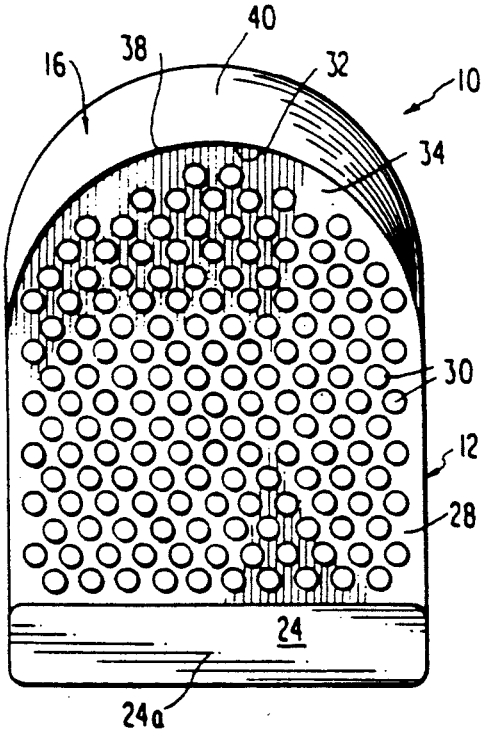
FIG. 3 is a bottom plan view thereof.

A principal aspect of the acupressure heel cup 10 of the present invention resides in the utilization of a plurality of laterally and longitudinally, closely spaced pegs 30 which are integrally molded with the sole 12, and which extend over the major surface area and which project outwardly of the bottom surface 28 thereof. As may be seen in FIG. 1, the pegs 30 are of decreasing vertical height, or depth from the sole bottom surface 28, in the direction from the horseshoe shaped rim 16 towards the front 22 of the sole. Further, those pegs 30 which are in proximity of the horseshoe shaped rim 16, but positioned forwardly of the vertical front surface 32 of that rim, are of a height extending planatarily beyond the rim in excess of the vertical height of the rim of 16 from lower edge 38 of the rim to the bottom surface 28 of the sole at the arcuate front wall 32 of rim 16. Pegs 30 are preferably solid and in the preferred embodiment are circular in horizontal cross section. As seen in FIG. 3, the pegs 30 are aligned transversely in front to rear, longitudinally spaced rows. Further, the pegs of longitudinally adjacent rows are laterally offset from the pegs in the immediate longitudinally adjacent row. As illustrated, the pegs 30 of one transverse row are centered in the gaps between the pegs 30 of a longitudinally adjacent row. Preferably, the sole 12 tapers in thickness from the portion proximate to the horseshoe shaped rim arcuate front wall 32 towards the acupressure heel cup front portion 22. Thus, the bottom surface 28 of the acupressure heel cup carries a series of rows of pegs or like projections 30 bordered in the rear by the horseshoe shaped rim 16 around opposite sides and the rear of the heel cup and surrounding the pegs 30 in that area. Both pegs 30 and the horseshoe shaped rim 16 project plantarly. The solid sole 12 of the unitary cup 10, above the rim is thin enough to permit the pegs 30 to apply pressure to the heel at localized points during a weight bearing. Such thin sole 12 is carried throughout the area bearing the pegs 30 which vary in thickness and height, decreasing in the direction of front 22 of the cup.

With the cup 10 worn in the heel of a shoe or other piece of article footwear, through the user's gait cycle, the posterior plantar aspect of the back of the patient's heel is the first to make contact at the proximal portion of the heel cup. The weight is then gradually transferred from posterior to anterior (rear to front) as the wearer moves through his or her normal gait. As the user's i.e., patient's body weight is borne on the heel from posterior to anterior, the pegs 30 are forced upwards, creating pressure points acting on the soft tissue of the heel. The action is a firm wave-like action of gentle pressure and massage from the back to the front of the heel cup. This action is then repeated on the heel of the user at each step the user takes. The action of gentle pressure and massage reduces the edema, congestion, and inflammation of the soft tissues to reduce heel pain and discomfort.

Preferably the acupressure heel cup 10 should be used in combination with other forms of treatment, such as local injections of anesthetic and steroid agents and the use of oral anti-inflammatory medications, when indicated. It should be noted that the acupressure heel cup is not designed to correct pronation of the foot which is true of certain known heel cups, pads or cushions. An acupressure heel cup 10 is placed in the heel of each of the shoes even though only one foot is affected in order to maintain proper balance and stability. Further, the acupressure heel cup performs an orthopedic function and may be readily transferable to other shoes, boots, or the like. Such an acupressure heel cup, as an orthopedic tool, is particularly effective in the treatment of heel spurs, bursitis of the heel, plantar fasciitis and associated leg problems such as shin splints and knee pain.

While a preferred embodiment of the present invention has been shown and described, it would be understood that such is merely illustrative and that changes may be made therein without departing from the scope and content of the invention as expressed by the following claims.

What is claimed is:

1. An acupressure heel cup for incorporation in footwear below the heel of the user, said heel cup comprising:

a relatively thin sole of a generally non-compressible, resilient, flexible material extending from a heel towards an arch of a foot of the user and having front, rear, laterally opposite side portions, and a bottom surface, the rear and side portions being curved upwardly, and forming a thickened, reinforced arcuate heel support, a horseshoe shaped rim integral with the sole portion and the heel support and projecting below the bottom surface of the sole at the rear thereof, a plurality of laterally and longitudinally, closely spaced pegs integral with the sole over a major bottom surface area thereof, and projecting outwardly of the bottom surface of the sole, said pegs being of decreasing vertical height from the rim to the front of said sole, and said pegs adjacent to said rim, having a vertical height extending plantarily beyond said rim in excess of the vertical height of said rim, whereby;

during ambulation, the posterior plantar aspect of the heel first makes contact at a proximal portion of the heel cup, the weight of the user is gradually transferred from the back to the front of the heel cup, the pegs are forced upwardly, creating individual pressure points against the soft tissues of the heel and a firm wave-like action of gentle pressure and massage is repeated, at each step of the user.

2. The acupressure heel cup as claimed in claim 1, wherein said pegs are solid.

3. The acupressure heel cup as claimed in claim 2, wherein said pegs are circular in horizontal cross section.

4. The acupressure heel cup as claimed in claim 1, wherein said pegs are aligned transversely in rows.

5. The acupressure heel cup as claimed in claim 4, wherein said pegs of longitudinally adjacent rows are laterally offset from each other.

6. The acupressure heel cup as claimed in claim 5, wherein the pegs of one transverses row are centered in the gaps between the pegs of the longitudinally adjacent row.

7. The acupressure heel cup as claimed in claim 1, wherein the said sole portion is generally of uniform thickness from rear portion to the front portion of the sole.

8. The acupressure heel cup as claimed in claim 1, wherein the front of the sole is devoid of said pegs and has a thickness which is less than a thickness of the sole behind the front thereof and the downwardly projecting pegs integral therewith.

9. The acupressure heel cup as claimed in claim 1, wherein said heel cup is of a molded elastomer plastic.

10. The acupressure heel cup as claimed in claim 1, wherein said heel cup is formed of a molded rubber.

11. The acupressure heel cup as claimed in claim 8, wherein said heel cup is formed of molded silicone rubber.

* * * * *